US008379906B2

(12) United States Patent
Kang

(10) Patent No.: US 8,379,906 B2
(45) Date of Patent: Feb. 19, 2013

(54) SENSORY SIGNAL OUTPUT APPARATUS

(75) Inventor: Yun Gyu Kang, Bucheon-si (KR)

(73) Assignee: Yea IL Electronics Co., Ltd., Incheon (KR)

( * ) Notice: Subject to any disclaimer, the term of this patent is extended or adjusted under 35 U.S.C. 154(b) by 221 days.

(21) Appl. No.: 13/063,109

(22) PCT Filed: Jun. 4, 2009

(86) PCT No.: PCT/KR2009/002981

§ 371 (c)(1),
(2), (4) Date: Mar. 9, 2011

(87) PCT Pub. No.: WO2010/030071

PCT Pub. Date: Mar. 18, 2010

(65) Prior Publication Data

US 2011/0164780 A1 Jul. 7, 2011

(30) Foreign Application Priority Data

Sep. 10, 2008 (KR) ..... 10-2008-0089279

(51) Int. Cl.
*H04R 25/00* (2006.01)

(52) U.S. Cl. ..... 381/415; 381/396; 381/412

(58) Field of Classification Search ..... 381/396, 381/412, 414–415

See application file for complete search history.

(56) References Cited

U.S. PATENT DOCUMENTS 7,149,323 B2 * 12/2006 Yamagishi ..... 381/415
7,248,714 B2 * 7/2007 Tsuda ..... 381/415
8,280,096 B2 * 10/2012 Milot ..... 381/415

FOREIGN PATENT DOCUMENTS

JP 63-164797 A 7/1988

(Continued)

OTHER PUBLICATIONS

International Search Report, Appln No. PCT/KR2009/002981, dated Feb. 12, 2010.

*Primary Examiner* — Suhan Ni

(74) *Attorney, Agent, or Firm* — Kile Park Goekjian Reed & McManus PLLC

(57) ABSTRACT

The present invention provides a sensory signal output apparatus wherein a coil is disposed in the gap between a magnet/top plate and a yoke, and a portion elastically supported in the free space vibrates in reaction to the magnetic flux generated in the gap in accordance with the direction of the alternating current signal applied to the coil to generate sound and/or vibration, wherein the yoke has a groove formed at a side other than that with the magnet, and the groove has a diameter smaller than that of the magnet, and an inner edge portion with a magnetic fluid. The sensory signal output apparatus of the present invention improves the position retaining force of the magnetic fluid and reduces the deformation of the magnetic fluid, as the magnetic fluid is formed in the edge of the groove of the yoke corresponding to the edge portion of the magnet which has a relatively bigger magnetic force and magnetic field than the plane portion of the magnet. Further, as the magnetic fluid is formed in the edge of the groove such that the magnetic fluid is present at both sides (the horizontal side and the vertical side) extending from the edge, the magnetic fluid at the horizontal side serves to relieve impact caused by a collision against peripheral elements during vibration, and the magnetic fluid at the vertical side corrects center deviation during vibration.

17 Claims, 5 Drawing Sheets

FOREIGN PATENT DOCUMENTS

| | | | |
|---|---|---|---|
| JP | 2004-015687 | A | 1/2004 |
| KR | 10-0500129 | B1 | 7/2005 |
| KR | 10-2006-0046360 | A | 5/2006 |
| KR | 10-0842092 | B1 | 6/2008 |

* cited by examiner

SENSORY SIGNAL OUTPUT APPARATUS

TECHNICAL FIELD

The present invention relates to a sensory signal output apparatus.

BACKGROUND ART

Generally, a sensory signal output apparatus is an apparatus, such as a speaker, a receiver, a buzzer or a vibratory device (including a vibrator and a linear motor), which converts an electrical signal input from a signal source into a mechanical signal to output sound or vibration.

The sensory signal output apparatus is configured so that a coil is disposed in a gap defined between a yoke and a magnet/top plate sequentially stacked on and fixed to the top of the yoke by bonding or welding in a state in which the coil is fixed to one side of a vibratory plate, and a magnetic circuit package constituted by the yoke, the magnet/top plate and/or the coil and the vibratory plate vibrate in reaction to magnetic flux generated in the gap in a direction of an alternating current signal applied to the coil to generate sound and/or vibration.

The main vibrating member (for example, the magnetic circuit package) collides with peripheral elements during vibration with the result that impact noise is generated or the main vibrating member and the peripheral elements are damaged. In recent years, a magnetic fluid has been used as a shock-absorbing member in order to solve the above problems.

The magnetic fluid is formed at a side of the yoke included in the main vibrating member opposite to the side to which the magnet is mounted along the diameter of the magnet, i.e., at a portion corresponding to the outer edge of the magnet, in an annular shape.

This is because the magnetic fluid is collected to the edge portion of the magnet, on which magnetic force concentrates, according to the properties related to the intensity of magnetic force of the magnet in that the magnet has great magnetic force at the edge portion thereof and the intensity of a magnetic field is increased toward the edge portion of the magnet.

DISCLOSURE

Technical Problem

In the conventional structure in which the magnetic fluid is formed, however, a plane formed as the magnetic fluid is attracted due to magnetic force is a single plane with the result that cohesive force is low, and therefore, the magnetic fluid is scattered about upon collision.

Also, in the conventional structure in which the magnetic fluid is formed, the periphery of the magnetic fluid is contaminated due to the above described problem.

Also, in the conventional structure in which the magnetic fluid is formed, only a shock-absorbing function is performed.

Technical Solution

In accordance with an aspect of the present invention, there is provided a sensory signal output apparatus configured so that a coil is disposed in a gap between a magnet/top plate and a yoke, and a portion elastically supported in a free space vibrates in reaction to magnetic flux generated in the gap in a direction of an alternating current signal applied to the coil to generate sound and/or vibration, wherein the yoke has a groove formed at a side other than that with the magnet and the groove has a diameter smaller than that of the magnet and is provided at an inner edge portion thereof with a magnetic fluid.

Advantageous Effects

The sensory signal output apparatus according to the present invention improves the position retaining force of the magnetic fluid and reduces the deformation of the magnetic fluid, as the magnetic fluid is formed at the edge of the groove of the yoke corresponding to the edge portion of the magnet which has a larger magnetic force and magnetic field than the plane portion of the magnet.

In addition, as the magnetic fluid is formed at the edge of the groove so that the magnetic fluid is present at both sides (the horizontal side and the vertical side) extending from the edge, the magnetic fluid at the horizontal side serves to relieve impact caused by a collision against peripheral elements during vibration, and the magnetic fluid at the vertical side corrects center deviation during vibration.

DESCRIPTION OF REFERENCE NUMERALS

10: Sensory signal output apparatus
11: Magnet
12: Top plate
13: Yoke
13*a*: Groove
14: Coil
15: Weight
16: Leaf spring
20: Magnetic fluid
1: Case
2: Cover

BEST MODE

Figure 1:
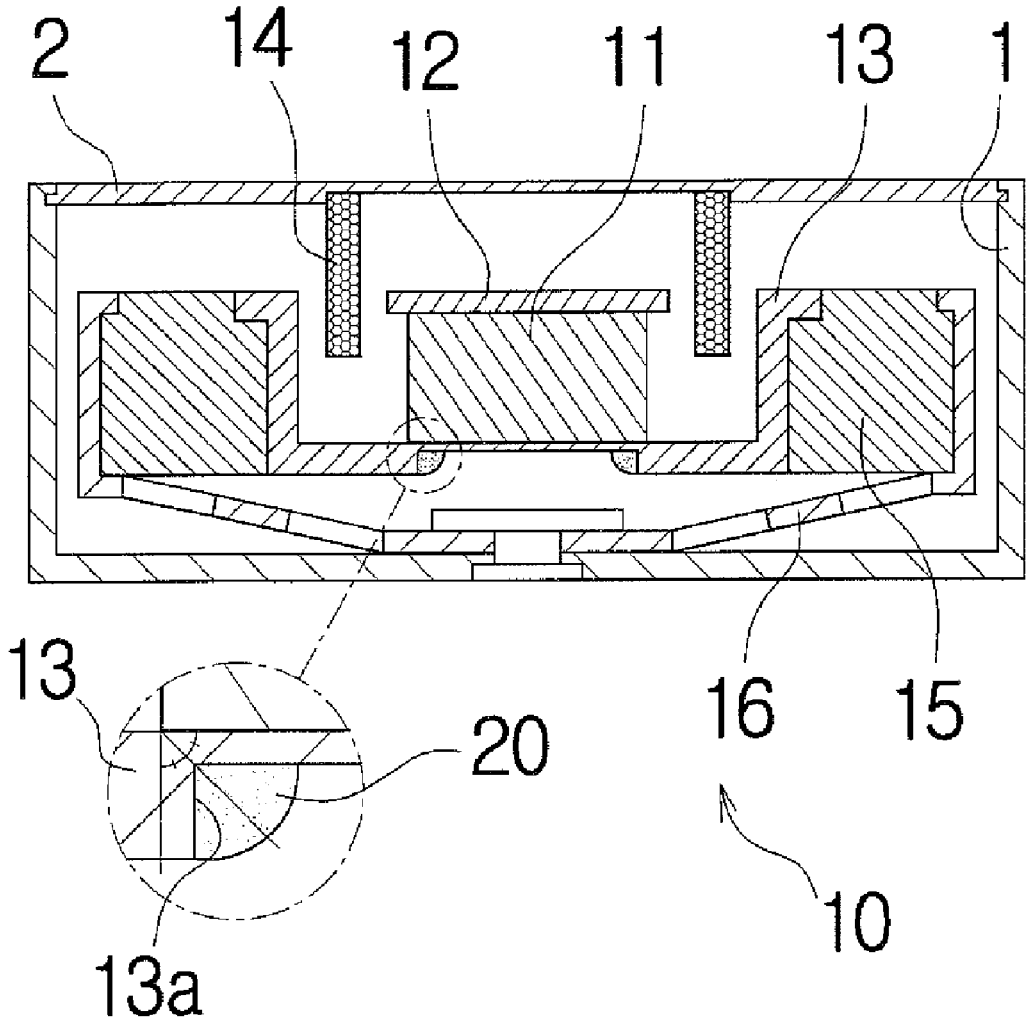
FIG. 1 is a sectional view showing the construction of a sensory signal output apparatus according to an embodiment of the present invention.
Figure 2:
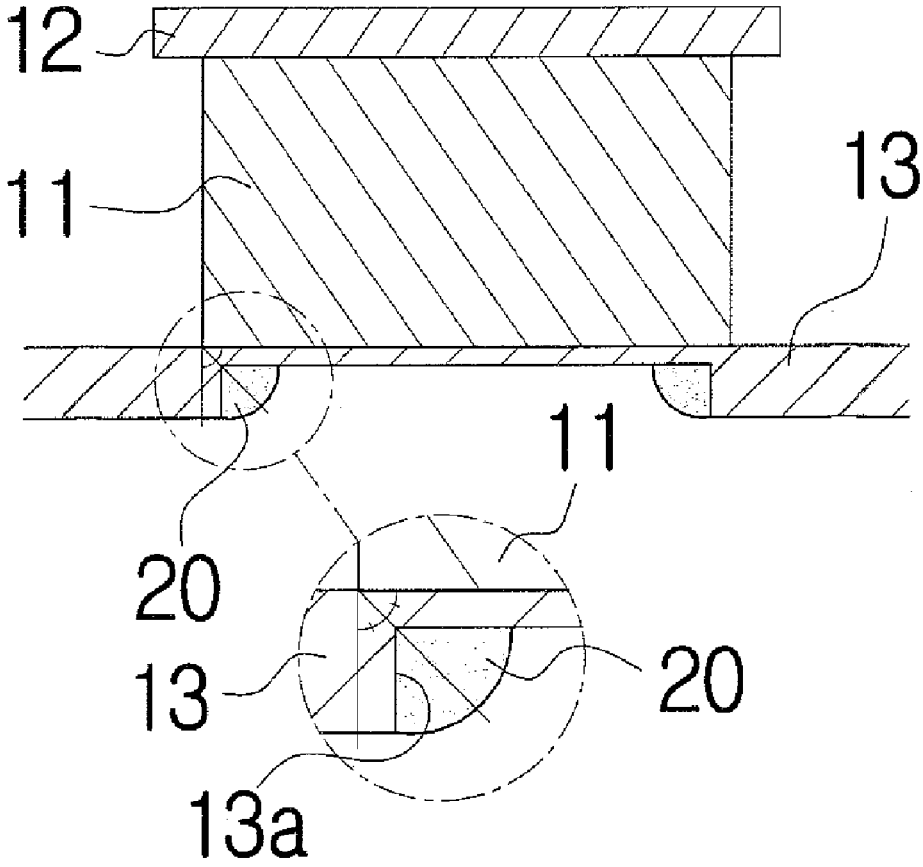
FIG. 2 is a partially enlarged sectional view showing the principal part of the sensory signal output apparatus according to the embodiment of the present invention.
Figure 3:
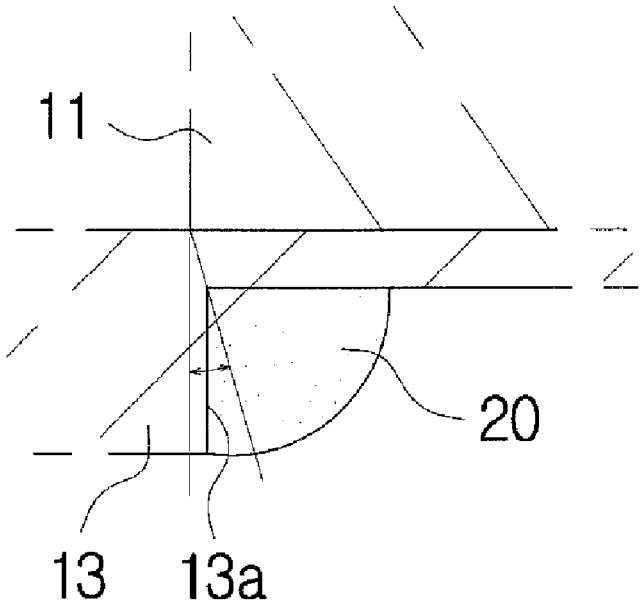
FIGS. 3 and 4 are partially enlarged sectional views showing other forms of a groove of the sensory signal output apparatus according to the embodiment of the present invention.
Figure 4:
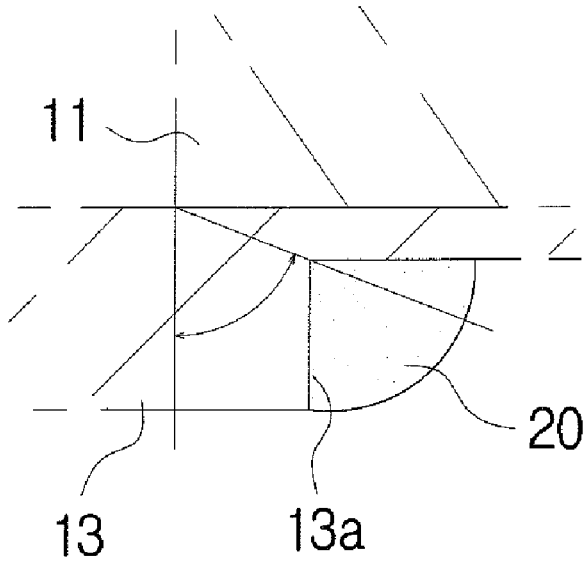
Figure 5:
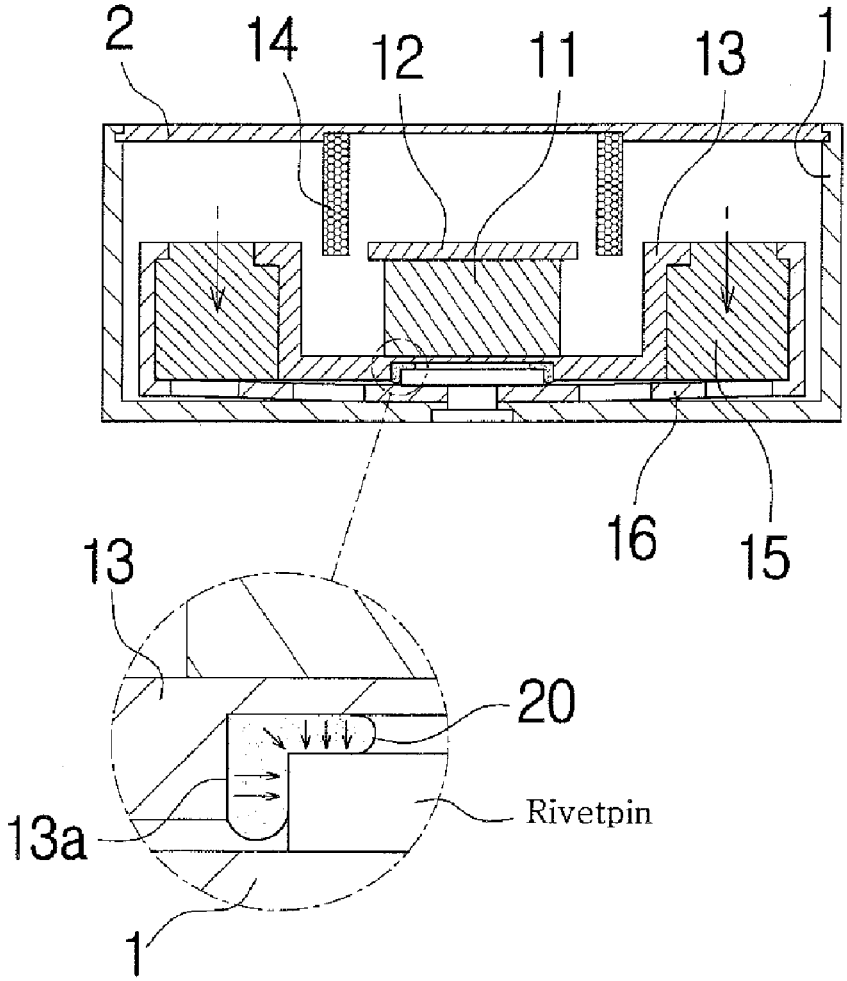
FIG. 5 is a partially enlarged sectional view showing a state in which attractive force is applied to the sensory signal output apparatus according to the embodiment of the present invention.
Figure 6:
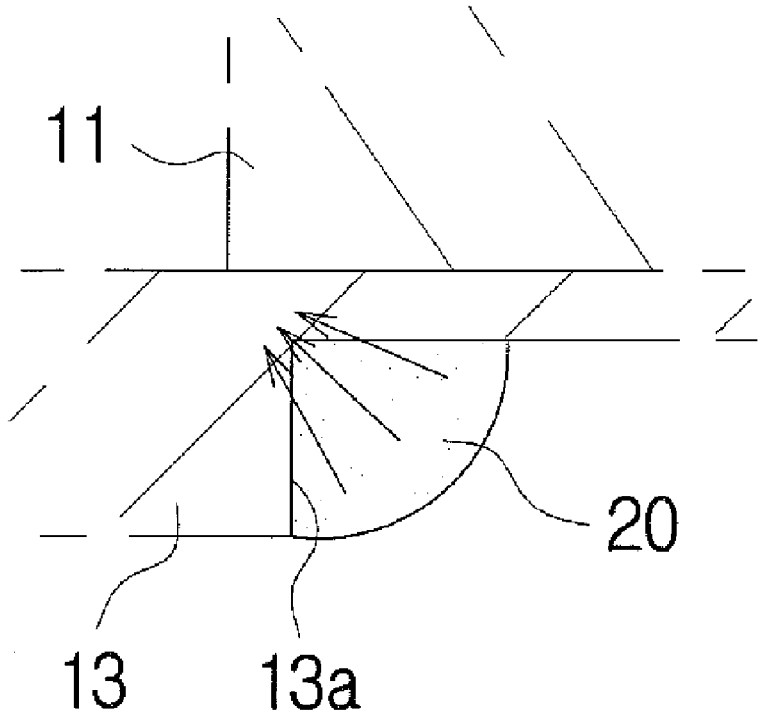
FIG. 6 is a sectional view showing shock absorption and correction of the sensory signal output apparatus according to the embodiment of the present invention.
Figure 7:
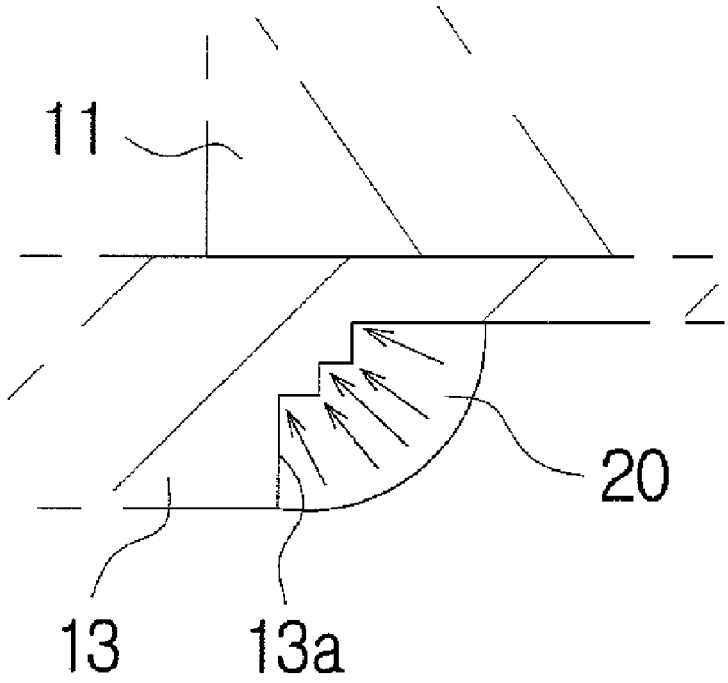
FIGS. 7 and 8 are partially enlarged sectional views showing yet other forms of the groove of the sensory signal output apparatus according to the embodiment of the present invention.
Figure 8:
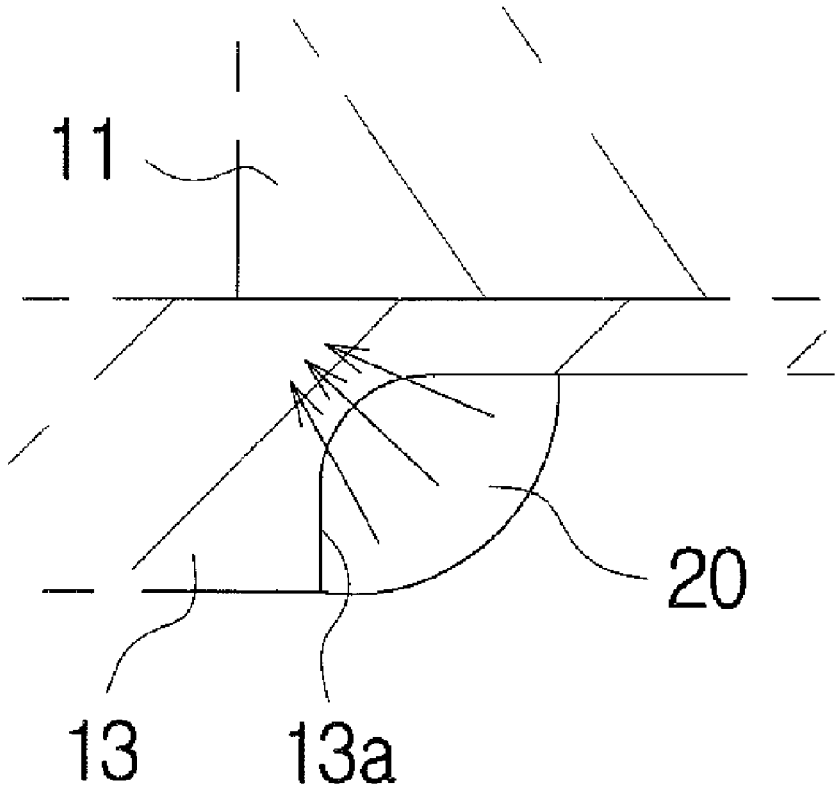

Before describing the present invention, the accompanying drawings provided to assist the prevent invention to be understood include the following figures. FIG. 1 is a sectional view showing the construction of a sensory signal output apparatus according to an embodiment of the present invention, FIG. 2 is a partially enlarged sectional view showing the principal part of the sensory signal output apparatus according to the embodiment of the present invention, FIGS. 3 and 4 are partially enlarged sectional views showing other forms of a groove of the sensory signal output apparatus according to the embodiment of the present invention, FIG. 5 is a partially enlarged sectional view showing a state in which attractive force is applied to the sensory signal output apparatus according to the embodiment of the present invention, FIG. 6 is a sectional view showing shock absorption and correction of the sensory signal output apparatus according to the embodiment of the present invention, and FIGS. 7 and 8 are partially enlarged sectional views showing yet other forms of the groove of the sensory signal output apparatus according to the embodiment of the present invention. In the drawings, reference numeral 10 indicates a sensory signal output apparatus to which the present invention is applied, and reference numeral 20 indicates a magnetic fluid.

Now, a preferred embodiment of the present invention will be described in detail with reference to the accompanying drawings.

First, as shown in FIG. 1, a sensory signal output apparatus according to an embodiment of the present invention is configured so that a coil 14 is disposed in a gap between a magnet/top plate 11 and 12 and a yoke 13, and a portion elastically supported in a free space vibrates in reaction to magnetic flux generated in the gap in the direction of an alternating current signal applied to the coil 14 to generate sound and/or vibration, wherein the yoke 13 has a groove 13*a* formed at a side other than that with the magnet 11, and the groove 13*a* has a diameter smaller than that of the magnet 11 and is provided at an inner edge portion thereof with a magnetic fluid 20.

In this embodiment of the present invention, the yoke 13 may be a circular plate which is formed in a '⊔' shape in section and bent outward at the outer circumferential edge thereof.

The magnet 11 and the top plate 12 may be fixedly mounted to the yoke 13 in a state in which the magnet 11 and the top plate 12 are spaced apart from the inner circumference of the yoke 13 to define a gap therebetween.

The magnet 11 and the top plate 12 may be fixedly mounted to the yoke 13 by bonding.

Meanwhile, in this embodiment of the present invention, an annular weight 15 may be fitted on the outer circumference of the yoke 13. The middle portion of a leaf spring 16 may be fixed to the middle portion of the inside bottom of a case 1 by a rivet in a state in which the outer circumference of the weight 15 is gripped by the inner circumference of the leaf spring 16 in a pressed state.

The leaf spring 16 may be inclined upward from the middle portion thereof, which is fixed by the rivet, to the outer portion thereof.

Meanwhile, in this embodiment of the present invention, the groove 13*a*, formed at the middle portion of the outside bottom of the yoke 13, may be provided at a more inner position than the side to which the magnet 11 is mounted as shown in FIG. 2.

An inner edge angle (an angle defined between the horizontal side (the bottom of the groove of the yoke) and the vertical side (the inner circumference of the groove of the yoke)) of the groove 13*a* may be a right angle, an acute angle (an angle smaller than a right angle), or an obtuse angle (an angle larger than a right angle).

In a case in which the inner edge angle of the groove 13*a* is an acute angle, the inner circumference and the bottom of the groove 13*a* surround the magnetic fluid 20, thereby improving cohesive force and capturing force of the magnetic fluid 20. On the other hand, in a case in which the inner edge angle of the groove 13*a* is an obtuse angle, a space defined between the inner circumference and the bottom of the groove 13*a* is wide, and therefore, it is possible to form a larger amount of magnetic fluid 20 in the space defined between the inner circumference and the bottom of the groove 13*a* than in a case in which the inner edge angle of the groove 13*a* is a right angle or an acute angle.

Also, as shown in FIG. 2, the inner edge of the groove 13*a* may be located at an equiangular portion of an angle defined between a vertical line and a horizontal line at the edge of the magnet 11 mounted to the yoke 13.

In this case, the magnetic fluid 20, located at the bottom and the inner circumference of the groove 13*a*, is attracted, with the same intensity, to the edge portion of the magnet 11 at which magnetic force and the intensity of a magnetic field are large.

In a case in which the angle defined between the vertical line and the horizontal line at the edge of the magnet 11 mounted to the yoke 13 is a right angle, the inner edge of the groove 13*a* may be located at a 45-degree angular line of the yoke 13 inclined downward and inward from the edge of the magnet 11 as shown in FIG. 2, the inner edge of the groove 13*a* may be adjacent to the edge of the magnet 11 with the result that the angle is narrow as shown in FIG. 3, or may be distant from the edge of the magnet 11 with the result that the angle is wide as shown in FIG. 4.

In a case in which the position of the inner edge of the groove 13*a* is changed from the equiangular portion of the angle defined between the vertical line and the horizontal line at the edge of the magnet 11 mounted to the yoke 13 as described above, such change in position of the inner edge of the groove 13*a* is possible within a range in which the inner edge of the groove 13*a* is influenced by the magnetic force and the intensity of the magnetic field generated at the edge of the magnet 11.

As shown in FIG. 5, the inner edge portion of the groove 13*a* of the yoke 13 is provided at the inside of the magnet 11 rather than at the edge of the magnet 11 at which the magnetic force and the intensity of the magnetic field are large. Consequently, a band (annular band) of the magnetic fluid 20 formed at the edge portion of the groove 13*a* is attracted to the edge of the magnet 11.

Also, the groove 13 has two sides, such as a vertical side and a horizontal side. Consequently, the sides of the groove 13 to which the magnetic fluid is collected are wider than a plane, and the two sides capture the magnetic fluid while surrounding the magnetic fluid.

As a result, position retaining force of the magnetic fluid is increased, and deformation of the magnetic fluid is reduced, as compared with a conventional technology in which the magnetic fluid is collected due to magnetic force concentrating on the plane edge, i.e. the outer circumference edge, of the magnet.

When an electric signal is applied, i.e. electric current flows, to the coil 14 fixed to the middle portion of a cover 2 coupled to the opening of the case 1 as shown in FIG. 6, an electromagnetic field is alternately formed in the flow direction of the electric current. The electromagnetic field reacts with magnetic flux formed in the gap between the magnet/top plate 11 and 12 and the yoke 13 to generate repulsive suction force.

In a state in which the coil 14 is fixed, a magnetic circuit package constituted by the magnet/top plate 11 and 12, the yoke 13 and the weight 15 is elastically supported in a free space by the leaf spring 16. Consequently, the magnetic circuit package vibrates in a state in which the magnetic circuit package advances to and retreats from the coil 14.

During this operation, the portion at which the leaf spring 16 is fixed to the case 1 by the rivet may collide with the yoke 13. In this embodiment of the present invention, however, the groove 13*a* is formed at the bottom of the yoke 13. Consequently, the head of the rivet pin is located in the groove 13*a*, and impact is relieved by the magnetic fluid 20 formed at the inner edge of the groove 13*a*.

At this time, as shown enlargedly, the magnetic fluid 20 located at the horizontal side portion of the groove 13*a* absorbs shock caused by a collision against the head of the rivet pin, and, in addition, the magnetic fluid 20 located at the vertical side portion of the groove 13*a* uniformly surrounds the outer circumference of the head of the rivet pin, thereby correcting the position of the magnetic circuit package, which vibrates upward and downward in a state in which the magnetic circuit package is twisted as the result of the magnetic circuit package deviating from the original position, so that the magnetic circuit package returns to the original position thereof.

If the magnetic circuit package vibrates in a twisted state as described above, the edge portion of the head of the rivet pin may collide with the outer edge of the groove 13*a* of the yoke 13 with the result that noise is generated or the head of the rivet pin and the outer edge of the groove may be damaged. In this embodiment of the present invention, the magnetic fluid 20 prevents the collision between the edge portion of the head of the rivet pin and the outer edge of the groove of the yoke, thereby preventing the generation of noise or damage to the head of the rivet pin and the outer edge of the groove.

Preferably, the magnetic fluid protrudes more than the bottom of the yoke 13.

In this embodiment of the present invention, the inner edge portion of the groove 13*a* may be a multiple edge (annular multi-step projection) formed in a saw-toothed shape as shown in FIG. 7.

In this case, the area of the inner edge portion of the groove corresponding to the edge of the magnet 11 is increased with the result that the number of cohesion points of the magnetic fluid 20 is increased in correspondence to magnetic force from the magnet 11, thereby further increasing the cohesion area of the magnetic fluid.

The angle of the protruding edge portion of the multiple edge and the angle of the inner edge portion of the multiple edge may be the same. Alternatively, the angle of the protruding edge portion of the multiple edge and the angle of the inner edge portion of the multiple edge may be irregular.

Also, in this embodiment of the present invention, the inner edge portion of the groove 13*a* may be curved as shown in FIG. 8.

In this case, the magnetic fluid 20 is attracted at a wide and uniform angle with respect to the edge of the magnet 11.

In this embodiment of the present invention, the groove 13*a* is formed at the outer bottom of the yoke 13. In another embodiment of the present invention, however, the groove 13*a* may be formed at the top of the top plate 12 so that the groove 13*a* has a diameter less than that of the magnet 11, and the magnetic fluid 20 may be formed at the edge portion of the groove 13*a*. Also, the groove 13*a* may be formed at both the yoke 13 and the top plate 12.

In this case, the magnetic fluid 20 is attracted to the upper edge portion of the magnet 11, thereby achieving the above effect.

The present invention has been described and shown based on the preferred embodiment to illustrate the principle of the invention. However, the present invention is not limited to the construction and operation of the embodiment which has been described and shown.

On the contrary, those skilled in the art will appreciate that various modifications and substitutions are possible without departing from the scope and spirit of the invention as disclosed in the accompanying claims.

Therefore, it should be noted that such modifications, substitutions and equivalents fall into the scope of the present invention.

The invention claimed is:

1. A sensory signal output apparatus configured so that a coil (14) is disposed in a gap between a magnet/top plate (11) (12) and a yoke (13), and a portion elastically supported in a free space vibrates in reaction to magnetic flux generated in the gap in a direction of an alternating current signal applied to the coil (14) to generate sound and/or vibration, wherein the yoke (13) has a groove (13*a*) formed at a side other than that with the magnet (11), and the groove (13*a*) has a diameter smaller than that of the magnet (11) and is provided at an inner edge portion thereof with a magnetic fluid (20).

2. The sensory signal output apparatus according to claim 1, wherein the yoke (13) comprises a circular plate which is formed in a '⊔' shape in section and bent outward at an outer circumferential edge thereof.

3. The sensory signal output apparatus according to claim 1, wherein the groove (13*a*), formed at a middle portion of an outside bottom of the yoke (13), is provided at a more inner position than the side to which the magnet (11) is mounted.

4. The sensory signal output apparatus according to claim 1, wherein an angle of the inner edge of the groove (13*a*) is a right angle.

5. The sensory signal output apparatus according to claim 1, wherein an angle of the inner edge of the groove (13*a*) is an acute angle.

6. The sensory signal output apparatus according to claim 1, wherein an angle of the inner edge of the groove (13*a*) is an obtuse angle.

7. The sensory signal output apparatus according to claim 1, wherein the inner edge of the groove (13*a*) is located at an equiangular portion of an angle defined between a vertical line and a horizontal line at an edge of the magnet (11) mounted to the yoke (13).

8. The sensory signal output apparatus according to claim 7, wherein the equiangular portion has an angle of 45 degrees.

9. The sensory signal output apparatus according to claim 1, wherein the inner edge of the groove (13*a*) is located adjacent to the edge of the magnet (11) at an equiangular portion of an angle defined between a vertical line and a horizontal line at an edge of the magnet (11) mounted to the yoke (13).

10. The sensory signal output apparatus according to claim 9, wherein the inner edge of the groove (13*a*) is located adjacent to the edge of the magnet (11) between the edge of the magnet (11) and the equiangular portion on the vertical line.

11. The sensory signal output apparatus according to claim 1, wherein the inner edge of the groove (13*a*) is located distant from the edge of the magnet (11) at an equiangular portion of an angle defined between a vertical line and a horizontal line at an edge of the magnet (11) mounted to the yoke (13).

12. The sensory signal output apparatus according to claim 11, wherein the inner edge of the groove (13*a*) is located distant from the edge of the magnet (11) by a length equal to a height from the equiangular portion to an inner circumference of the groove (13*a*).

13. The sensory signal output apparatus according to claim 1, wherein the inner edge portion of the groove (13*a*) comprises a multiple edge formed in a saw-toothed shape.

14. The sensory signal output apparatus according to claim 13, wherein a protruding edge and an inner edge of the multiple edge have the same angle.

15. The sensory signal output apparatus according to claim 13, wherein a protruding edge and an inner edge of the multiple edge have irregular angles.

16. The sensory signal output apparatus according to claim 1, wherein the inner edge portion of the groove (13*a*) is curved.

17. The sensory signal output apparatus according to claim 1, wherein the groove (13*a*) is formed at a top of the top plate (12) so that the groove (13*a*) has a diameter less than that of the magnet (11), and the magnetic fluid (20) is formed at the edge portion of the groove (13*a*).

* * * * *